US011572529B2

(12) United States Patent
Bennett et al.

(10) Patent No.: US 11,572,529 B2
(45) Date of Patent: Feb. 7, 2023

(54) LIQUID LAUNDRY DETERGENT COMPOSITIONS

(71) Applicant: Conopeo, Inc., Englewood Cliffs, NJ (US)

(72) Inventors: Julie Bennett, Merseyside (GB); Robert John Carswell, Merseyside (GB); Eva-Maria Reis-Walther, Ludwigshafen (DE); David Christopher Thorley, Merseyside (GB); Juergen Gert Tropsch, Ludwigshafen (DE); Holger Michael Tuerk, Ludwigshafen (DE)

( * ) Notice: Subject to any disclaimer, the term of this patent is extended or adjusted under 35 U.S.C. 154(b) by 0 days.

(21) Appl. No.: 17/171,888

(22) Filed: Feb. 9, 2021

(65) Prior Publication Data

US 2021/0163848 A1 Jun. 3, 2021

Related U.S. Application Data

(63) Continuation of application No. 16/099,994, filed as application No. PCT/EP2017/060052 on Apr. 27, 2017, now Pat. No. 10,947,480.

(30) Foreign Application Priority Data

May 17, 2016 (EP) ..... 16169850

(51) Int. Cl.

| | |
|---|---|
| ***C11D 1/02*** | (2006.01) |
| ***C11D 1/14*** | (2006.01) |
| ***C11D 1/22*** | (2006.01) |
| ***C11D 1/29*** | (2006.01) |
| ***C11D 1/72*** | (2006.01) |
| ***C11D 1/83*** | (2006.01) |
| ***B08B 3/04*** | (2006.01) |
| ***C11D 3/00*** | (2006.01) |
| ***C11D 3/37*** | (2006.01) |
| ***C11D 3/386*** | (2006.01) |
| ***C11D 3/40*** | (2006.01) |
| ***C11D 3/50*** | (2006.01) |
| ***C11D 11/00*** | (2006.01) |

(52) U.S. Cl.

CPC ..... *C11D 1/83* (2013.01); *C11D 3/0026* (2013.01); *C11D 3/0036* (2013.01); *C11D 3/3715* (2013.01); *C11D 3/3723* (2013.01); *C11D 3/3869* (2013.01); *C11D 3/40* (2013.01); *C11D 3/50* (2013.01); *C11D 11/0017* (2013.01); *C11D 1/146* (2013.01); *C11D 1/22* (2013.01); *C11D 1/29* (2013.01); *C11D 1/72* (2013.01)

(58) Field of Classification Search

CPC .... C11D 1/02; C11D 1/14; C11D 1/22; C11D 1/29; C11D 1/72; C11D 1/83; B08B 3/04

See application file for complete search history.

(56) References Cited

U.S. PATENT DOCUMENTS

| | | | | |
|---|---|---|---|---|
| 5,075,026 | A | 12/1991 | Loth et al. | |
| 5,308,401 | A | 5/1994 | Geke et al. | |
| 5,403,508 | A | 4/1995 | Reng et al. | |
| 5,599,476 | A | 2/1997 | Behler et al. | |
| 5,716,924 | A | 2/1998 | Balaguer et al. | |
| 6,015,780 | A | 1/2000 | Llosas Bigorra et al. | |
| 6,737,553 | B1 | 5/2004 | Maas et al. | |
| 7,348,460 | B2 | 3/2008 | Wulff et al. | |
| 7,371,716 | B2 | 5/2008 | Ruland et al. | |
| 8,519,196 | B2 | 8/2013 | Klumpe et al. | |
| 9,080,132 | B2 | 7/2015 | Gayral Chirac et al. | |
| 2002/0058602 | A1 | 5/2002 | Eskuchen et al. | |
| 2004/0180022 | A1 | 9/2004 | Denzligil | |
| 2005/0215452 | A1 | 9/2005 | Ruland et al. | |
| 2006/0074005 | A1 | 4/2006 | Kischkel et al. | |
| 2009/0023820 | A1* | 1/2009 | Dailey ..... | C11D 1/37 516/204 |
| 2010/0227930 | A1 | 9/2010 | Lusignan | |
| 2010/0323942 | A1 | 12/2010 | Evers et al. | |
| 2011/0152157 | A1 | 6/2011 | Woo et al. | |
| 2011/0260101 | A1 | 10/2011 | Rittig et al. | |
| 2011/0277786 | A1 | 11/2011 | Zhu et al. | |

(Continued)

FOREIGN PATENT DOCUMENTS

| | | |
|---|---|---|
| CA | 2072009 | 6/1991 |
| CN | 105026538 | 11/2015 |
| DE | 4342215 | 6/1995 |
| EP | 0068520 | 1/1983 |

(Continued)

OTHER PUBLICATIONS

Search Report and Written Opinion in EP16169850; dated Nov. 2, 2016.

Search Report and Written Opinion in EP16169849; dated Nov. 9, 2016.

Search Report and Written Opinion in PCTEP2017060052; dated Jul. 27, 2017.

Search Report and Written Opinion in PCTEP2017061506; dated Jul. 27, 2017.

Li Wenbin; Production Technology of Fine Chemicals; Production Technology of Fine Chemicals; Jan. 2014; p. 28 (total of 4 pages) with original and manual transation of relevant parts ; Japan.

(Continued)

*Primary Examiner* — Brian P Mruk

(74) *Attorney, Agent, or Firm* — Greenberg Traurig, LLP

(57) ABSTRACT

A liquid laundry composition comprising: (i) one or more anionic surfactants; and (ii) a non-ionic ethoxylated C10 Guerbet alcohol surfactant with a degree of ethoxylation in the range of 1 to 10; wherein the total amount of anionic surfactant in the composition is in the range of 3 to 18 wt % of the total composition and the weight ratio of the total amount of anionic surfactant to the non-ionic ethoxylated C10 Guerbet alcohol surfactant is in the range of 6:1 to 60:1. Use of a liquid laundry detergent composition including said non-ionic ethoxylated C10 Guerbet alcohol surfactant for laundering textiles wherein effective foam is maintained during a main wash step and an easy rinse of the textiles is provided during a rinse step.

6 Claims, No Drawings

(56) References Cited

U.S. PATENT DOCUMENTS

| | | | | |
|---|---|---|---|---|
| 2012/0046214 | A1* | 2/2012 | Braeckman | C11D 1/94 510/235 |
| 2015/0005222 | A1* | 1/2015 | Hunt, Jr | C11D 11/0023 510/407 |

FOREIGN PATENT DOCUMENTS

| | | |
|---|---|---|
| EP | 0709450 | 5/1996 |
| EP | 1905819 | 4/2008 |
| EP | 2036973 | 3/2009 |
| EP | 2420557 | 2/2012 |
| JP | 2010275473 | 12/2010 |
| JP | 2011153231 | 8/2011 |
| JP | 2012107102 | 6/2012 |
| WO | WO9103540 | 3/1991 |
| WO | WO9109925 | 7/1991 |
| WO | WO9117233 | 11/1991 |
| WO | WO9404639 | 3/1994 |
| WO | WO9411330 | 5/1994 |
| WO | WO9412607 | 6/1994 |
| WO | WO9419449 | 9/1994 |
| WO | WO9505441 | 2/1995 |
| WO | WO9506702 | 3/1995 |
| WO | WO9528470 | 10/1995 |
| WO | WO9705223 | 2/1997 |
| WO | WO9919440 | 4/1999 |
| WO | WO9964553 | 12/1999 |
| WO | WO0039058 | 7/2000 |
| WO | WO03091192 | 11/2003 |
| WO | WO2003091190 | 11/2003 |
| WO | WO2004033403 | 4/2004 |
| WO | WO2005037757 | 4/2005 |
| WO | WO2006079598 | 8/2006 |
| WO | WO2007076337 | 7/2007 |
| WO | WO2007096292 | 8/2007 |
| WO | WO2008148420 | 12/2008 |
| WO | WO2009060171 | 5/2009 |
| WO | WO2010029279 | 3/2010 |
| WO | WO2010070088 | 6/2010 |
| WO | WO2010073067 | 7/2010 |
| WO | WO2010121975 | 10/2010 |
| WO | WO2011003904 | 1/2011 |
| WO | WO2011066276 | 6/2011 |
| WO | WO2011116775 | 9/2011 |
| WO | WO2012022008 | 2/2012 |
| WO | WO2012024076 | 2/2012 |
| WO | WO2012076432 | 6/2012 |
| WO | WO2012080197 | 6/2012 |
| WO | WO2012164190 | 12/2012 |
| WO | WO2013160216 | 10/2013 |
| WO | WO2014012869 | 1/2014 |
| WO | WO2014085271 | 6/2014 |
| WO | WO2014095793 | 6/2014 |
| WO | WO2014118053 | 8/2014 |
| WO | WO2014131584 | 9/2014 |
| WO | WO2015103736 | 7/2015 |

OTHER PUBLICATIONS

Chen Ling; Study Research on the synthesis and properties of isomeric fatty alcohol polyoxyethylene other and their derivatives; Study Research on the synthesis and properties of isomeric fatty alcohol polyoxyethylene other and their derivatives; Jul. 15, 2012; Issue 7.

Chen Ling; Study Research on the synthesis and properties of isomeric fatty alcohol polyoxyethylene other and their derivatives; Study Research on the synthesis and properties of isomeric fatty alcohol polyoxyethylene other and their derivatives; Jul. 15, 2012; Issue 07.

Opposition Notice of 3458561 (EP17721590.2); Jul. 20, 2021.

* cited by examiner

LIQUID LAUNDRY DETERGENT COMPOSITIONS

RELATED APPLICATIONS

The present application is a divisional of 16/099,994, filed on Nov. 8, 2018, that has issued as U.S. Pat. No. 10,947,480, which is a national phase filing under 35 USC 371 of International Application No. PCT/EP2017/060052, filed on Apr. 27, 2017, which claims priority from European Patent Application No. 16169850.1, filed on May 17, 2016, the contents of which are incorporated herein in their entirety for all purposes.

TECHNICAL FIELD

This invention relates to liquid laundry detergent compositions comprising one or more anionic surfactants and a non-ionic ethoxylated $C_{10}$ Guerbet alcohol surfactant, and use of such compositions as an easy-rinse laundry detergent.

BACKGROUND

Foaming is an important aspect of the user's perception of cleaning ability in laundry detergents. There is a general consumer perception that foam volume indicates the cleaning ability of a laundry composition. Therefore, it is important to provide a sufficient foam from a laundry composition during use In general, an increase in volume of foam provides a good perception with the consumer. However, other properties of the foam may be undesirable. For example, persistent foam can be undesirable because persistent foam may require more water and/or a longer wash cycle to rinse away the foam.

Laundry detergent compositions are typically added to the wash water (rather than, for example, directly applied to clothes to be washed) and are required to foam in relatively dilute water conditions. The foaming ability of a composition depends on the mixture of components in the composition, and surfactants play an important role in the ability of a laundry composition to foam when in use. Typically, an increase in the amount of anionic surfactant in a composition will lead to an increase in foaming. However, an increase in anionic surfactant levels can lead to an increase in cost of the laundry detergent composition and may require several rinses with clean water in order to rinse out the laundry detergent satisfactorily.

SUMMARY OF THE INVENTION

It is an aim of the present invention to provide satisfactory foaming from a laundry composition during laundry cleaning, while also providing excellent rinsing ability of the compositions.

In a first aspect, the present invention provides a liquid laundry composition comprising:

(i) one or more anionic surfactants; and (ii) a non-ionic ethoxylated $C_{10}$ Guerbet alcohol surfactant with a degree of ethoxylation in the range of 1 to 10;

wherein the total amount of anionic surfactant in the composition is in the range of 3 to 18 wt % based on the total composition and the weight ratio of the total amount of anionic surfactant to the non-ionic ethoxylated $C_{10}$ Guerbet alcohol surfactant is in the range of 6:1 to 60:1.

The present inventors have surprisingly found that such a liquid laundry composition provides excellent foaming ability during the main wash process, even when the anionic surfactant concentration in the laundry composition is relatively low. Such formulations also provide easier rinsing during the rinsing process.

In a second aspect, the present invention provides use of a liquid laundry detergent composition according to the first aspect to launder textiles.

DETAILED DESCRIPTION OF THE INVENTION

As used herein, the term "degree of ethoxylation" refers to the number of moles of ethylene oxide reacted with one mole of $C_{10}$ Guerbet alcohol to produce the ethoxylated $C_{10}$ Guerbet alcohol surfactant. It should be recognised that a distribution of ethoxylated reaction products is normally obtained during ethoxylation of alcohols. Typically, the degree of ethoxylation may therefore be designated as the "average degree of ethoxylation", namely the average number of moles of ethylene oxide unit per mole of ethoxylated product.

Amounts of components in the liquid laundry detergent are given as a percentage of weight based on the total weight of the composition, unless otherwise stated.

Anionic Surfactant

The composition of the present invention includes one or more anionic surfactants in an amount in the range of 3 to 18 wt %. Anionic surfactants suitable for use in liquid laundry detergents are known. In general, the anionic surfactant(s) may be chosen from the surfactants described "Surface Active Agents" Vol. 1, by 5 Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Types of Anionic Surfactant

Suitable anionic surfactants which may be used are usually water soluble alkali metal salts of organic carboxylates, sulphates and sulphonates having alkyl radicals containing from about 8 to about 22 carbon atoms, the term alkyl being used to include the alkyl portion of higher acyl radicals. Non-limiting examples of anionic surfactants useful herein include: $C_9$-$C_{18}$ alkyl benzene sulphonates (LAS); $C_{10}$-$C_{20}$ primary, branched-chain and random alkyl sulphates (AS); $C_{10}$-$C_{18}$ secondary (2,3) alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. Nos. 6,020,303 and 6,060,443; mid-chain branched alkyl alkoxy sulphates as discussed in U.S. Pat. Nos. 6,008,181 and 6,020,303; modified alkylbenzene sulphonate (MLAS) as discussed in WO 99/05243, WO 99/05242, and WO 99/05244; methyl ester sulphonate (MES); and alpha olefin sulfonate (AOS).

The preferred anionic surfactants are sodium $C_{11}$ to $C_{15}$ alkyl benzene sulphonates, sodium $C_8$ to $C_{18}$ alcohol ether sulphates and sodium $C_{12}$ to $C_{18}$ alkyl sulphates. Also applicable are surfactants such as those described in EP-A-328 177 (Unilever), which show resistance to salting-out, the alkyl polyglycoside surfactants described in EP A 070 074, and alkyl monoglycosides.

In some embodiments, the composition includes a $C_8$ to $C_{18}$ alcohol ether sulphate as an anionic surfactant. The $C_8$-$C_{18}$ alcohol ether sulphate may be derived from a fatty alcohol, wherein at least 80 wt %, preferably at least 82 wt %, more preferably at least 85 wt %, most preferably at least 90 wt % of said fatty alcohol is linear. By linear, what is meant is that the fatty alcohol comprises a single backbone of carbon atoms, with no branches.

In some embodiments, $C_8$ to $C_{18}$ alcohol ether sulphates are the sole anionic surfactants in the composition. In other embodiments, $C_9$ to $C_{18}$ alkyl benzene sulphonates are the sole anionic surfactants in the composition When the composition includes a $C_8$-$C_{18}$ alcohol ether sulphate, the degree of ethoxylation of the $C_8$-$C_{18}$ alcohol ether sulphate is typically an integer in the range of 1 to 5. In preferred embodiments, the degree of ethoxylation of the $C_8$-$C_{18}$ alcohol ether sulphate is 1, 2 or 3, more preferably 1 or 3.

In preferred embodiments, the composition includes sodium lauryl ether sulphate (also known as sodium dodecyl ether sulphate or SLES) as an anionic surfactant. In some embodiments, the degree of ethoxylation of SLES is 1, 2 or 3. In some embodiments, the degree of ethoxylation of SLES is 3. In other embodiments, the degree of ethoxylation of SLES is 2. In further embodiments, the degree of ethoxylation of SLES is 1.

Two or More Anionic Surfactants

In some embodiments, the composition includes two or more anionic surfactants. The composition may include a $C_8$-$C_{18}$ alcohol ether sulphate and one or more further anionic surfactant. The composition may include a $C_9$-$C_{18}$ alkyl benzene sulphonate and one or more further anionic surfactant. In some embodiments, the composition includes a $C_8$-$C_{18}$ alcohol ether sulphate and a $C_9$-$C_{18}$ alkyl benzene sulphonate.

In some embodiments, the composition includes a $C_8$-$C_{18}$ alcohol ether sulphate or a $C_9$-$C_{18}$ alkyl benzene sulphonate in a ratio of about 1:4 to 4:1 to other anionic surfactants (when present) in the composition. In preferred embodiments the composition includes a $C_8$-$C_{18}$ alcohol ether sulphate or a $C_9$-$C_{18}$ alkyl benzene sulphonate in a ratio of about 2:3 to 7:2 to other anionic surfactants (when present) in the composition. In some embodiments the composition includes a $C_8$-$C_{18}$ alcohol ether sulphate or a $C_9$-$C_{18}$ alkyl benzene sulphonate in a ratio of about 2:3 to 3:2 to other anionic surfactants (when present) in the composition. In other embodiments, the composition includes a $C_8$-$C_{18}$ alcohol ether sulphate or a $C_9$-$C_{18}$ alkyl benzene sulphonate in a ratio of about 5:2 to 7:2 to other anionic surfactants (when present) in the composition.

In preferred embodiments, the composition includes sodium lauryl ether sulphate (SLES) and one or more further anionic surfactants. In further embodiments, the composition includes sodium lauryl ether sulphate (SLES) and sodium dodecyl benzene sulphonate (NaLAS).

Amount of Anionic Surfactant

The anionic surfactant or surfactants are present in the composition in an amount in the range of 3 to 18 wt %. In some embodiments, the anionic surfactant or surfactants are present in the composition in an amount in the range of 5 to 17 wt %, preferably 7 to 16 wt %, more preferably 8 to 15 wt %.

In some embodiments, the composition comprises 7 to 16 wt % of anionic surfactants, including 2 to 12 wt % of $C_8$-$C_{18}$ alcohol ether sulphate (preferably SLES) and 1 to 8 wt % of a $C_9$-$C_{18}$ alkyl benzene sulphonates (preferably sodium dodecyl benzene sulphonate).

The anionic surfactants of the present application are typically salts, for example alkali metal salts. The salts also may be organic, for example salts of triethanol amine (TEA) or monoethanol amine (MEA). However, any of the anionic surfactants of the present application may be included in the composition of the present invention in the acid form. For example, the composition may include a linear alkyl sulfonic acid as an anionic surfactant.

Non-Ionic Ethoxylated $C_{10}$ Guerbet Alcohol Surfactant

The compositions of the present invention includes one or more a non-ionic ethoxylated $C_{10}$ Guerbet alcohol surfactants with a degree of ethoxylation in the range of 1 to 10 as a minor surfactant component. The non-ionic ethoxylated $C_{10}$ Guerbet alcohol surfactant or surfactants act as an easy rinse component. The total amount of a non-ionic ethoxylated $C_{10}$ Guerbet alcohol surfactant with a degree of ethoxylation in the range of 1 to 10 in the composition is in a weight ratio in the range of 1:6 to 1:60 with respect to the total amount of anionic surfactant in the composition.

Guerbet alcohols are known and well defined β-alkylated dimer alcohols. Typically, the non-ionic ethoxylated $C_{10}$ Guerbet alcohol surfactant with a degree of ethoxylation in the range of 1 to 10 is represented by formula (I):

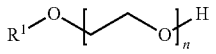

(I)

wherein $R^1$ is a 2-propyl heptyl group and n represents the degree of ethoxylation and is an integer in the range of 1 to 10.

In some embodiments, the total amount of a non-ionic ethoxylated $C_{10}$ Guerbet alcohol surfactant with a degree of ethoxylation in the range of 1 to 10 included in the composition is in an amount in the range of 0.05 to 3 wt %. In further embodiments, the total amount of non-ionic ethoxylated $C_{10}$ Guerbet alcohol surfactant with a degree of ethoxylation in the range of 1 to 10 is in an amount in the range of 0.01 to 2.0 wt %, preferably 0.1 to 1.0 wt %.

In some embodiments, the non-ionic ethoxylated $C_{10}$ Guerbet alcohol surfactant has a degree of ethoxylation in the range of 3 to 10, 3 to 6, or 3 to 5.

Examples of $C_{10}$ Guerbet alcohol surfactant with a degree of ethoxylation of 3, 4 or 5 include Lutensol® XP-30, Lutensol® XP-40 and Lutensol® XP-50 from BASF Corporation. In some embodiments, the non-ionic ethoxylated $C_{10}$ Guerbet alcohol surfactant has a degree of ethoxylation of 4 or 5. In some embodiments, the non-ionic ethoxylated $C_{10}$ Guerbet alcohol surfactant is a $C_{10}$ Guerbet alcohol surfactant with a degree of ethoxylation of 4.

The composition of the present invention may include two or more of the non-ionic ethoxylated $C_{10}$ Guerbet alcohol surfactants with a degree of ethoxylation in the range of 1 to 10. In other words, the composition may include two or more non-ionic ethoxylated $C_{10}$ Guerbet alcohol surfactants, each surfactant having a different degree of ethoxylation in the range of 1 to 10.

When a mixture of non-ionic ethoxylated $C_{10}$ Guerbet alcohol surfactants with a degree of ethoxylation in the range of 1 to 10 is included in the composition, the total amount of the non-ionic ethoxylated $C_{10}$ Guerbet alcohol surfactant with a degree of ethoxylation in the range of 1 to 10 is within the specified ranges of the present invention, namely the total amount of the non-ionic ethoxylated $C_{10}$ Guerbet alcohol surfactant with a degree of ethoxylation in the range of 1 to 10 in the composition is in a weight ratio in the range of 1:6 to 1:60 with respect to the total amount of anionic surfactant in the composition.

Ratio of Anionic Surfactant to Non-Ionic Ethoxylated $C_{10}$ Guerbet Alcohol Surfactant with a Degree of Ethoxylation in the Range of 1 to 10

The weight ratio of total anionic surfactant to non-ionic ethoxylated $C_{10}$ Guerbet alcohol surfactant with a degree of ethoxylation in the range of 1 to 10 in the composition is typically in the range of 6:1 to 60:1. In other words, the non-ionic ethoxylated $C_{10}$ Guerbet alcohol surfactant with a degree of ethoxylation in the range of 1 to 10 is the minor surfactant component.

In some embodiments, the weight ratio of total anionic surfactant to non-ionic ethoxylated $C_{10}$ Guerbet alcohol surfactant with a degree of ethoxylation in the range of 1 to 10 in the composition is in the range 8:1 to 50:1. In other embodiments, the weight ratio of total anionic surfactant to non-ionic ethoxylated $C_{10}$ Guerbet alcohol surfactant in the composition is in the range of 12:1 to 40:1.

Other Surfactants

The composition may include other surfactants. These include additional non-ionic surfactants (which are not non-ionic ethoxylated $C_{10}$ Guerbet alcohol surfactants with a degree of ethoxylation in the range of 1 to 10), cationic surfactants, amphoteric surfactants and/or zwitter-ionic surfactants.

In some embodiments, the composition is substantially free of or includes up to 5 wt % of one or more zwitter-ionic surfactants. Preferred examples of zwitter-ionic surfactants are $C_{12}$-$C_{14}$ dimethyl amine oxide and cocamidopropyl betaine (CAPB). In preferred embodiments the composition is substantially free of zwitter-ionic surfactant. In other embodiments, the composition optionally includes up to 3 wt %, preferably up to 1 wt % zwitter-ionic surfactant(s).

In some embodiments, the composition includes SLES with a degree of ethoxylation of 3 and up to 3 wt % of CAPB. In some embodiments, the composition also includes a salt, such as sodium chloride, when the composition includes CAPB.

Other Ingredients

Advantageously the composition comprises one or more polymers that are included in the composition such as cleaning polymers, viscosity control polymers, structuring polymers and polymers for colour and garment care. Preferred polymers include ethoxylated polyethylene imine (available as Sokalan HP20 ex. BASF) and/or polyester soil release polymers. Preferably the detergent liquid further comprises at least 0.5 wt % ethoxylated polyethylene imine polymer. Most preferably it further comprises at least 0.2 wt % of polyester soil release polymers. More preferably the composition comprises at least 1 wt % of ethoxylated polyethylene imine.

The detergent composition may comprise an effective amount of at least one enzyme selected from the group comprising, pectate lyase, protease, amylase, cellulase, lipase, mannanases.

Enzyme Stabilizers:

Any enzyme present in the composition may be stabilized using conventional stabilizing agents, e.g., a polyol for example propylene glycol or glycerol, a sugar or sugar alcohol, lactic acid, boric acid, or a boric acid derivative, e.g., an aromatic borate ester, or a phenyl boronic acid derivative for example 4-formylphenyl boronic acid, and the composition may be formulated as described in e.g. WO 92/19709 and WO 92/19708.

Fluorescent Agents:

It may be advantageous to include fluorescer in the compositions. Usually, these fluorescent agents are supplied and used in the form of their alkali metal salts, for example, the sodium salts. The total amount of the fluorescent agent or agents used in the composition is generally from 0.005 to 2 wt %, more preferably 0.01 to 0.5 wt %.

Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra, Tinopal 5BMGX, and Blankophor (Trade Mark) HRH, and Pyrazoline compounds, e.g. Blankophor SN.

Preferred fluorescers are: sodium 2 (4-styryl-3-sulfophenyl)-2H-napthol[1,2-d]triazole, disodium 4,4'-bis{[(4-anilino-6-(N methyl-N-2 hydroxyethyl) amino 1,3,5-triazin-2-yl)]amino}stilbene-2-2' disulfonate, disodium 4,4'-bis{[(4-anilino-6-morpholino-1,3,5-triazin-2-yl)]amino} stilbene-2-2' disulfonate, and disodium 4,4'-bis(2-sulfoslyryl)biphenyl.

Bleach Catalyst:

Compositions may comprise a weight efficient bleach system. Such systems typically do not utilise the conventional percarbonate and bleach activator approach. An air bleach catalyst system is preferred. Suitable complexes and organic molecule (ligand) precursors for forming complexes are available to the skilled worker, for example, from: WO 98/39098; WO 98/39406, WO 97/48787, WO 00/29537; WO 00/52124, and WO00/60045, incorporated by reference. An example of a preferred catalyst is a transition metal complex of MeN4Py ligand (N,N-bis(pyridin-2-yl-methyl)-1-,1-bis(pyridin-2-yl)-1-aminoethane). Suitable bispidon catalyst materials and their action are described in WO02/48301. The bleach catalyst may be encapsulated to reduce interaction with other components of the liquid during storage.

Photobleaches may also be employed. A "photobleach" is any chemical species that forms a reactive bleaching species on exposure to sunlight, and preferably is not permanently consumed in the reaction. Preferred photo-bleaches include singlet oxygen photo-bleaches and radical photo-bleaches. Suitable singlet oxygen photo-bleaches may be selected from, water soluble phthalocyanine compounds, particularly metallated phthalocyanine compounds where the metal is Zn or Al-Z1 where Z1 is a halide, sulphate, nitrate, carboxylate, alkanolate or hydroxyl ion. Preferably the phthalocyanin has 1-4 $SO_3X$ groups covalently bonded to it where X is an alkali metal or ammonium ion. Such compounds are described in WO2005/014769 (Ciba).

When present, the bleach catalyst is typically incorporated at a level of about 0.0001 to about 10 wt %, preferably about 0.001 to about 5 wt %.

Perfume

Compositions may further comprise a perfume. The inclusion of perfumes into laundry detergent compositions is known per se.

When the composition is used at very low levels of product dosage, it is advantageous to ensure that perfume is employed efficiently.

A particularly preferred way of ensuring that perfume is employed efficiently is to use an encapsulated perfume. Use of a perfume that is encapsulated reduces the amount of perfume vapour that is produced by the composition before it is diluted. This is important when the perfume concentration is increased to allow the amount of perfume per wash to be kept at a reasonably high level.

It is even more preferable that the perfume is not only encapsulated but also that the encapsulated perfume is provided with a deposition aid to increase the efficiency of perfume deposition and retention on fabrics. The deposition aid is preferably attached to the encapsulate by means of a covalent bond, entanglement or strong adsorption, preferably by a covalent bond or entanglement.

Where perfume encapsulates are included, it is advantageous to include a structuring system in the liquid detergent to enable stable suspension of the perfume encapsulates throughout the liquid detergent Further Optional Ingredients:

The compositions may contain one or more other ingredients. Such ingredients include foam boosting agents, preservatives (e.g. bactericides), pH buffering agents, polyelectrolytes, anti-shrinking agents, anti-wrinkle agents, antioxidants, sunscreens, anti-corrosion agents, drape imparting agents, anti-static agents and ironing aids. The compositions may further comprise colorants, pearlisers and/or opacifiers, and shading dye.

Dye

Dyes are described in *Color Chemistry Synthesis, Properties and Applications of Organic Dyes and Pigments*, (H Zollinger, Wiley VCH, Zürich, 2003) and, Industrial Dyes Chemistry, Properties Applications. (K Hunger (ed), Wiley-VCH Weinheim 2003).

Dyes are soluble in the medium of application, in this case a laundry detergent liquid.

Dyes for use in liquid laundry detergents preferably have an extinction coefficient at the maximum absorption in the visible range (400 to 700 nm) of greater than 5000 L $mol^{-1}$ $cm^{-1}$, preferably greater than 10000 L $mol^{-1}$ $cm^{-1}$. Preferably the dyes are blue or violet in colour.

Preferred dye chromophores are azo, azine, anthraquinone, phthalocyanine and triphenylmethane.

Azo, anthraquinone, phthalocyanine and triphenylmethane dyes preferably carry a net anionic charged or are uncharged. Azine dyes preferably carry a net anionic or cationic charge.

Preferred non-shading dyes are selected are selected from blue dyes, most preferably anthraquinone dyes bearing sulphonate groups and triphenylmethane dye bearing sulphonate groups. Preferred compounds are acid blue 80, acid blue 1, acid blue 3; acid blue 5, acid blue 7, acid blue 9, acid blue 11, acid blue 13, acid blue 15, acid blue 17, acid blue 24, acid blue 34, acid blue 38, acid blue 75, acid blue 83, acid blue 91, acid blue 97, acid blue 93, acid blue 93:1, acid blue 97, acid blue 100, acid blue 103, acid blue 104, acid blue 108, acid blue 109, acid blue 110, and acid blue 213.

Blue or violet Shading dyes are most preferred. Shading dyes deposit to fabric during the wash or rinse step of the washing process providing a visible hue to the fabric. In this regard the dye gives a blue or violet colour to a white cloth with a hue angle of 240 to 345, more preferably 260 to 320, most preferably 270 to 300. The white cloth used in this test is bleached non-mercerised woven cotton sheeting.

The shading dye's fabric substantivity makes the neat contact staining worse.

Shading dyes are discussed in WO2005/003274, WO2006/032327 (Unilever), WO2006/032397 (Unilever), WO2006/045275 (Unilever), WO 2006/027086 (Unilever), WO2008/017570 (Unilever), WO 2008/141880 (Unilever), WO2009/132870 (Unilever), WO 2009/141173 (Unilever), WO 2010/099997 (Unilever), WO 2010/102861 (Unilever), WO 2010/148624 (Unilever), WO2008/087497 (P&G), WO2011/011799 (P&G), WO2012/054820 (P&G), WO2013/142495 (P&G) and WO2013/151970 (P&G).

A mixture of shading dyes may be used.

The shading dye chromophore is most preferably selected from mono-azo, bis-azo and azine.

Mono-azo dyes preferably contain a heterocyclic ring and are most preferably thiophene dyes. The mono-azo dyes are preferably alkoxylated and are preferably uncharged or anionically charged at pH=7. Alkoxylated thiophene dyes are discussed in WO2013/142495 and WO2008/087497. Preferred examples of thiophene dyes are shown below:

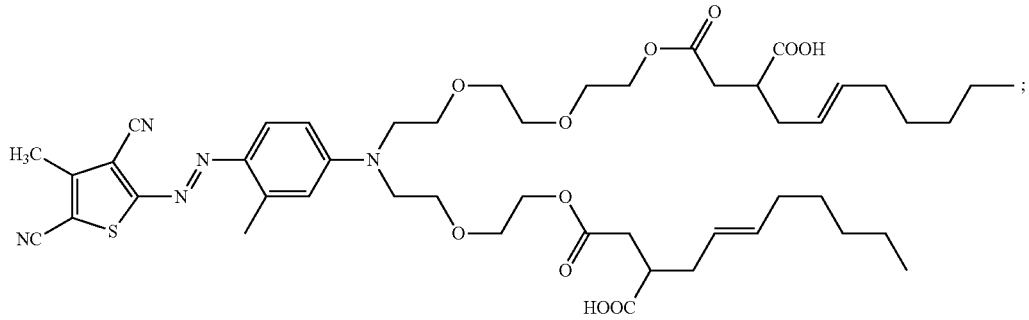

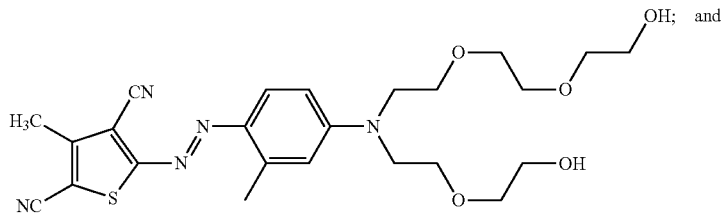

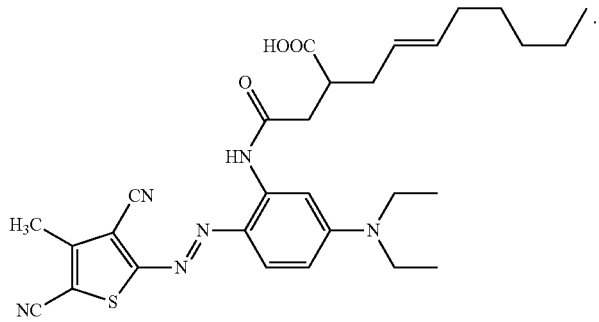

Bis-azo dyes are preferably sulphonated bis-azo dyes. Preferred examples of sulphonated bis-azo compounds are direct violet 7, direct violet 9, direct violet 11, direct violet 26, direct violet 31, direct violet 35, direct violet 40, direct violet 41, direct violet 51, direct violet 66, direct violet 99 and alkoxylated versions thereof.

Alkoxylated bis-azo dyes are discussed in WO2012/054058 and WO/2010/151906.

An example of an alkoxylated bis-azo dye is:

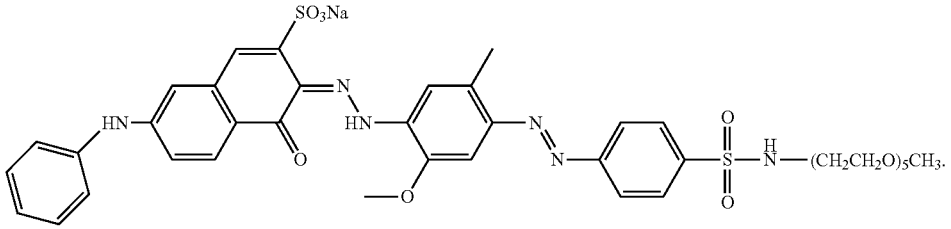

Azine dyes are preferably selected from sulphonated phenazine dyes and cationic phenazine dyes. Preferred examples are acid blue 98, acid violet 50, dye with CAS-No 72749-80-5, acid blue 59, and the phenazine dye selected from:

wherein:

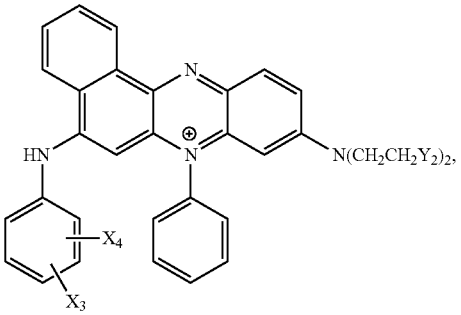

$X_3$ is selected from: —H; —F; —$CH_3$; —$C_2H_5$; —$OCH_3$; and, —$OC_2H_5$;

$X_4$ is selected from: —H; —$CH_3$; —$C_2H_5$; —$OCH_3$; and, —$OC_2H_5$;

$Y_2$ is selected from: —OH; —$OCH_2CH_2OH$; —CH(OH)$CH_2OH$; —OC(O)$CH_3$; and, C(O)$OCH_3$.

The shading dye is present is present in the liquid composition in range from 0.0001 to 0.1 wt %. Depending upon the nature of the shading dye there are preferred ranges depending upon the efficacy of the shading dye which is dependent on class and particular efficacy within any particular class. As stated above the shading dye is a blue or violet shading dye.

Builders and Sequestrants

The detergent compositions may also optionally contain organic detergent builder or sequestrant material. Examples include the alkali metal, citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids, and citric acid. Other examples are DEQUEST™, organic phosphonate type sequestering agents sold by Italmatch Chemicals and alkanehydroxy phosphonates.

Other suitable organic builders include the higher molecular weight polymers and copolymers known to have builder properties. For example, such materials include appropriate polyacrylic acid, polymaleic acid, and polyacrylic/polymaleic acid copolymers and their salts, for example those sold by BASF under the name SOKALAN™.

If utilized, the organic builder materials may comprise from about 0.5% to 20 wt %, preferably from 1 wt % to 10 wt %, of the composition. The preferred builder level is less than 10 wt % and preferably less than 5 wt % of the composition. A preferred sequestrant is HEDP (1-Hydroxyethylidene-1,1,-diphosphonic acid), for example sold as Dequest 2010. Also suitable but less preferred as it gives inferior cleaning results is Dequest® 2066 (Diethylenetriamine penta(methylene phosphonic acid or Heptasodium DTPMP).

Buffers

The presence of some buffer is preferred for pH control; preferred buffers are MEA, and TEA. If present they are preferably used in the composition at levels of from 1 to 15 wt %.

External Structurants

The compositions may have their rheology further modified by use of a material or materials that form a structuring network within the composition. Suitable structurants include hydrogenated castor oil, structuring polymers, microfibrous cellulose and natural based structurants for example citrus pulp fibre. Citrus pulp fibre is particularly preferred especially if lipase enzyme is included in the composition.

Visual Cues

The compositions may comprise visual cues of solid material that is not dissolved in the composition. Preferred visual cues are lamellar cues formed from polymer film and possibly comprising functional ingredients that may not be as stable if exposed to the alkaline liquid. Enzymes and bleach catalysts are examples of such ingredients. Also perfume, particularly microencapsulated perfume.

Packaging and Dosing

Preferably the liquids are supplied in multidose plastics packs with a top or bottom closure. A dosing measure may be supplied with the pack either as a part of the cap or as an integrated system.

The invention will now be further described with reference to the following non-limiting example.

EXAMPLE

A liquid laundry detergent including around 10 wt % of an anionic surfactant and around 1 wt % of a non-ionic ethoxylated $C_{10}$ Guerbet alcohol surfactant with a degree of ethyoxylation of 4 was compared in foaming tests against a control liquid laundry detergent including around 20 wt % anionic surfactant (with no non-ionic ethoxylated $C_{10}$ Guerbet alcohol surfactant). The liquid laundry detergent including the non-ionic ethoxylated $C_{10}$ Guerbet alcohol surfactant provided comparable foaming and fewer rinses were required for the wash than the control detergent composition.

Foaming tests were performed by adding a fixed amount of laundry detergent composition in a fixed volume of water and inverting the mixtures in a graduated vessel. The tests were performed three times and an average foam volume taken.

The invention claimed is:

1. A liquid laundry composition comprising:

surfactants consisting of:

(i) sodium lauryl ether sulphate (SLES) and sodium dodecyl benzene sulphonate (NaLAS);

wherein the total amount of anionic surfactant in the composition is 3 to 18 wt % of the total composition;

wherein a weight ratio of the sodium dodecyl benzene sulphonate to the sodium lauryl ether sulphate is 5:2 to 7:2; and (ii) a non-ionic ethoxylated $C_{10}$ Guerbet alcohol surfactant with a degree of ethoxylation of 1 to 4;

wherein the weight ratio of the total amount of anionic surfactant to the non-ionic ethoxylated $C_{10}$ Guerbet alcohol surfactant is 6:1 to 60:1 so as to result in the maintenance of an effective amount of foam; and water.

2. A liquid laundry composition according to claim 1 wherein the composition includes 0.05 to 2.0 wt % of the non-ionic ethoxylated $C_{10}$ Guerbet alcohol surfactant with a degree of ethoxylation of 1 to 4 based on the total weight of the composition.

3. A liquid laundry composition according to claim 1 wherein the composition includes 5 to 16 wt % of sodium lauryl ether sulphate (SLES) and sodium dodecyl benzene sulphonate (NaLAS).

4. A liquid laundry composition according to claim 1 wherein the weight ratio of the total amount of anionic surfactant to the non-ionic ethoxylated $C_{10}$ Guerbet alcohol surfactant is 8:1 to 60:1.

5. A liquid laundry composition according to claim 1 wherein the composition further includes one or more additional components selected from the group consisting of: ethoxylated polyethylene imine polymer; polyester soil release polymer; one or more enzymes; enzyme stabiliser; fluorescent agent; bleach catalyst; and perfume.

6. A liquid laundry composition comprising:

surfactants consisting of:

(i) sodium lauryl ether sulphate (SLES) and sodium dodecyl benzene sulphonate (NaLAS);

wherein the total amount of anionic surfactant in the composition is 3 to 18 wt % of the total composition; and (ii) a non-ionic ethoxylated $C_{10}$ Guerbet alcohol surfactant with a degree of ethoxylation of 1 to 4;

wherein the weight ratio of the total amount of anionic surfactant to the non-ionic ethoxylated $C_{10}$ Guerbet alcohol surfactant is 6:1 to 60:1 so as to result in the maintenance of an effective amount of foam; and water.

* * * * *